US005220304A

United States Patent [19]

Ho

[11] Patent Number: 5,220,304

[45] Date of Patent: Jun. 15, 1993

[54] SAFETY INSULATED TRANSFORMERS

[75] Inventor: Joseph K. P. Ho, Hunghom, Hong Kong

[73] Assignee: Astec International Limited, Hong Kong, Hong Kong

[21] Appl. No.: 887,553

[22] Filed: May 18, 1992

Related U.S. Application Data

[63] Continuation of Ser. No. 514,864, Apr. 26, 1990, abandoned.

[30] Foreign Application Priority Data

May 11, 1989 [GB] United Kingdom ..... 8910825.2

[51] Int. Cl.[5] ..... H01F 15/10; H01F 27/30

[52] U.S. Cl. ..... 336/192; 336/198; 336/206; 336/209

[58] Field of Search ..... 336/206, 209, 192, 69, 336/70, 229

[56] References Cited

U.S. PATENT DOCUMENTS

| | | | |
|---|---|---|---|
| 1,303,511 | 5/1919 | Shackelton | 336/206 |
| 2,154,070 | 4/1939 | Franz | 336/206 |
| 2,225,593 | 12/1940 | McArn | 336/206 |
| 2,279,581 | 4/1942 | Niemann | 336/206 |
| 2,534,119 | 12/1950 | Gethmann | 336/206 |
| 3,297,970 | 1/1967 | Jones | 336/206 |
| 3,533,037 | 10/1970 | Koch | 336/206 |
| 4,291,292 | 9/1981 | Witchger | 336/209 X |
| 4,376,904 | 3/1983 | Horrigan | 336/209 X |
| 4,494,102 | 1/1985 | Fisher et al. | 336/206 X |
| 4,634,911 | 1/1987 | Studniarz et al. | 336/209 X |

*Primary Examiner*—Thomas J. Kozma

*Attorney, Agent, or Firm*—McCubbrey, Bartels, Meyer & Ward

[57] ABSTRACT

A safety insulated transformer where there are at least three layers of safety approved insulating material between any parts of the wires forming first and second windings. The first winding is wrapped torroidally with a strip of safety approved insulating material, the successive layers of that wrapping overlapping to form at least two of the required layers of safety approved insulating material, and either overlapping to form all three required layers or at least one of the wires having a coating of safety approved insulation. Preferably the ends of the wire of the first winding have end insulation comprising coiled overlapped layers of safety insulation, and a layer of additional safety insulation material of at least two superimposed thicknesses makes a minimum of one and one half turns transversely of the coil of the first winding around the coil in the region or regions where the ends leave the coil.

8 Claims, 5 Drawing Sheets

SAFETY INSULATED TRANSFORMERS

This application is a continuation of application Ser. No. 07/514,864, now abandoned filed Apr. 26, 1990.

This invention relates to safety insulated transformers in which electrical energy from a primary or input coil is transferred to a secondary or output coil. In order to improve the coupling of energy from a primary coil to a secondary coil, a core of magnetic material such as ferrite is provided.

BACKGROUND TO THE INVENTION

Frequently transformers are provided in a circuit to provide isolation of two parts of the circuit and so safety requirements to ensure electrical isolation dictate the provision of certain minimum levels of insulation between the primary and secondary coils. For example, according to IEC 380 safety requirements of systems working at 130 to 250 VAC, both basic insulation and supplementary insulation are required in one case between a primary winding and a secondary winding. A basic insulation can be of any thickness which can withstand 1250 VAC and must have a creepage distance, that is to say the minimum surface distance over the insulation from a primary wire to a secondary wire, of at least 3 mm. A supplementary insulation should consist of two layers of insulation of any thickness which can withstand 2500 VAC or a minimum of 1 mm thick insulating material and a minimum of 4 mm creepage. In another case, a reinforced insulation can be used to replace both the basic and supplementary insulation. In this way the primary and secondary wires can be separated by a minimum of 2 mm thick reinforced insulation and a minimum creepage of 8 mm.

Generally therefore transformers have been made by winding a primary coil of enamelled wire on a bobbin whilst the secondary coil, also of enamelled wire, is wound on another bobbin which is then assembled concentrically with the bobbin of the primary coil. The minimum insulation requirement is met by the wall thickness of the bobbins between the two windings, whilst the minimum creepage distance is achieved by the design of the bobbins and control of the position of the windings on the bobbins.

In practice this limits the minimum radial distance between the primary and secondary coils to over 1 mm. However, the larger the spacing between the primary and secondary coils naturally the larger the flux leakage or loss in the transfer of energy from one to the other.

Also during each AC cycle applied to the primary coil, the energy initially has to overcome leakage inductance before any energy transfer occurs to make a current flow in the secondary coil. This wastes time during the cycle since, during the initial part of every cycle no energy transfer occurs, and the higher the frequency the greater and the more significant is this time loss and so the lower the efficiency of the transfer.

It is therefore an object of this invention to reduce the flux leakage from such transformers and so improve the efficiency of energy transfer of a transformer.

BRIEF SUMMARY OF THE INVENTION

According to the invention there is provided a transformer comprising a first winding formed by a coil of insulated wire, a magnetic core, a thin strip of safety approved insulating material wrapped as a torroidal coil around the first winding with an overlapping of successive layers of the wrapping to form at least two layers of insulation, a second winding formed by a coil of insulated wire wound over the wrapped first coil, there being at least three layers of safety approved insulating material between any parts of the wires forming the first and second windings.

In this way the transformer meets the existing regulations without requiring change in the regulations. Thus the three layers of safety approved insulation fulfil the requirements for basic and supplementary insulation.

Either of the first or second windings can the the primary or secondary winding of the transformer when it is in use.

The thin strip of safety approved insulating material wrapped as a torroidal coil around the first winding will typically have a thickness of 0.02 to 0.4 mm. More generally, however, it will have a thickness of 0.025 to 0.1 mm. Examples of preferred readily available materials have thicknesses of about 0.05 or about 0.025 mm and so even if the strip is wound so as to overlap three times, the total thickness of such insulation will only be 0.15 mm or 0.075 mm, respectively, in contrast with a typical thickness of at least 1 mm for the bobbin of the secondary coil for conventional transformers. It is therefore possible to reduce the spacing between the first and second coils and so reduce flux leakage and energy losses.

The wire of either of the windings can be of safety insulating material in which there need only be two superimposed layers in the overlapping of the wrapping. However, if neither of the wires of the windings has a safety insulating covering, e.g., both wires are enamelled wires, then there needs to be at least three superimposed layers in the overlapping of the wrapping.

According to a preferred embodiment of the invention there is additionally provided end insulation for the ends of the wire of the first coil in the region where these ends leave the coil, the end insulation comprises a roll or coil of overlapped layers of safety insulating material wrapped around those ends, and a piece of additional safety insulation material giving a minimum of 4 mm creepage between the first and second windings by, for example, making at least one and one half turns transversely of the coil around the coil in the region or regions where the said ends of the wire leave the coil, that piece of additional insulation material being comprised of at least two superimposed layers of safety insulation.

Preferably the two ends of the wire leave the coil at about the same circumferential position so that only one piece of additional insulation is necessary.

The invention also extends to a method of making a transformer in which the end portions of a length of insulated wire to form a first winding are wrapped with a roll of safety insulation, one end is passed substantially transversely across a bobbin on which the first winding is to be supported, a rectangular piece of safety insulation of at least two superimposed layers of safety insulation is placed over the transverse length of that end with flap portions ending beyond the width of the bobbin, the first winding is formed by coiling the wire around the bobbin and over the piece of insulation, and the other end passed under the piece of insulation and out of the side of the bobbin substantially coincident with the said one end, one flap portion is bent over the coil and the other flap portion bent over the said one flap portion, and a strip of safety approved insulation is wound as a torroidal coil over the assembly of coil and bobbin with at least two layers of the strip superimposed everywhere, and thereafter a second winding is formed by winding a coil of a further length of insulated wire over the resulting assembly, the arrangement being such that there are at least three layers of safety approved insulating material between any parts of the wires forming the first and second windings.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
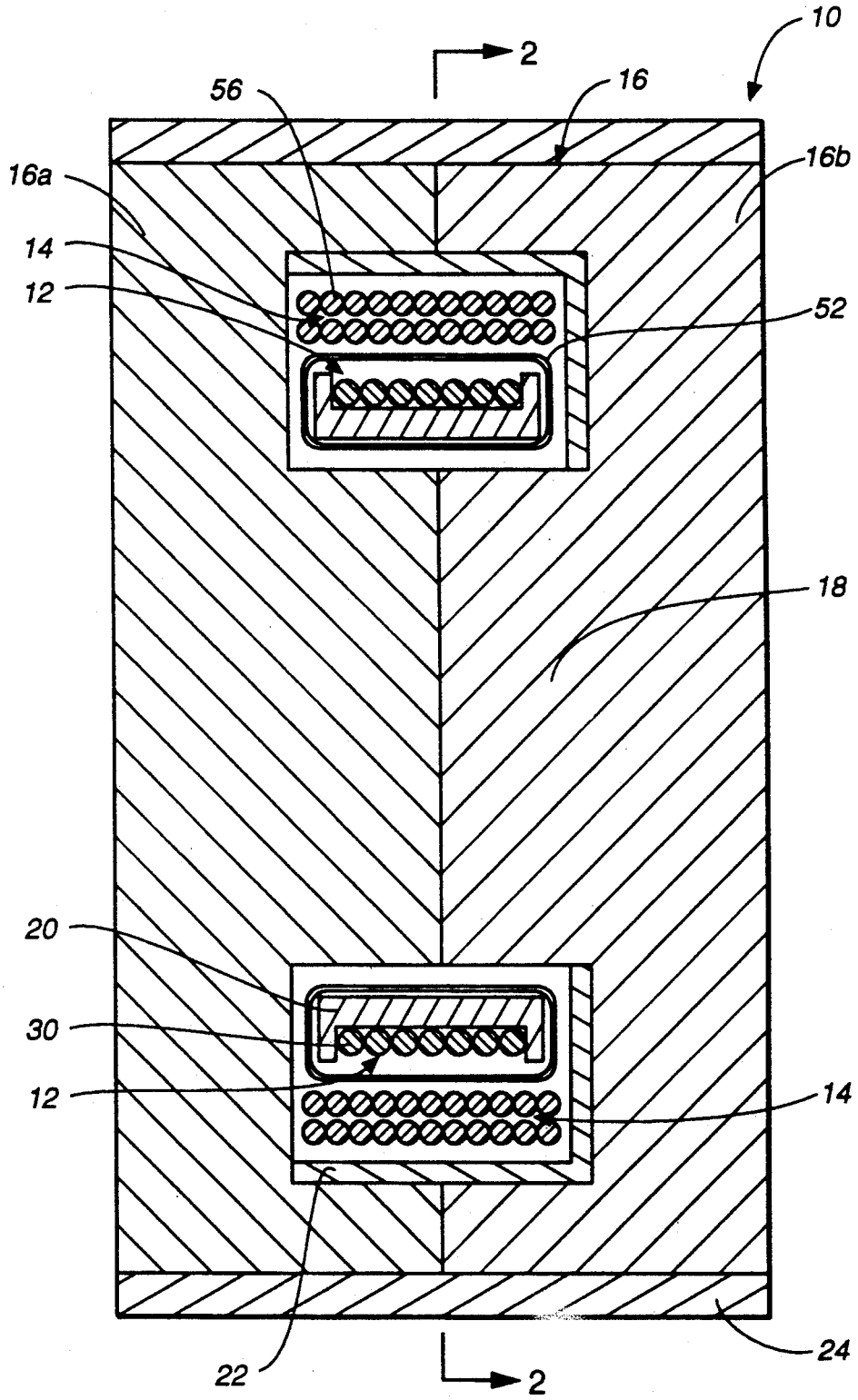
FIG. 1 is an upright section through an example of a transformer according to the invention.
Figure 2:
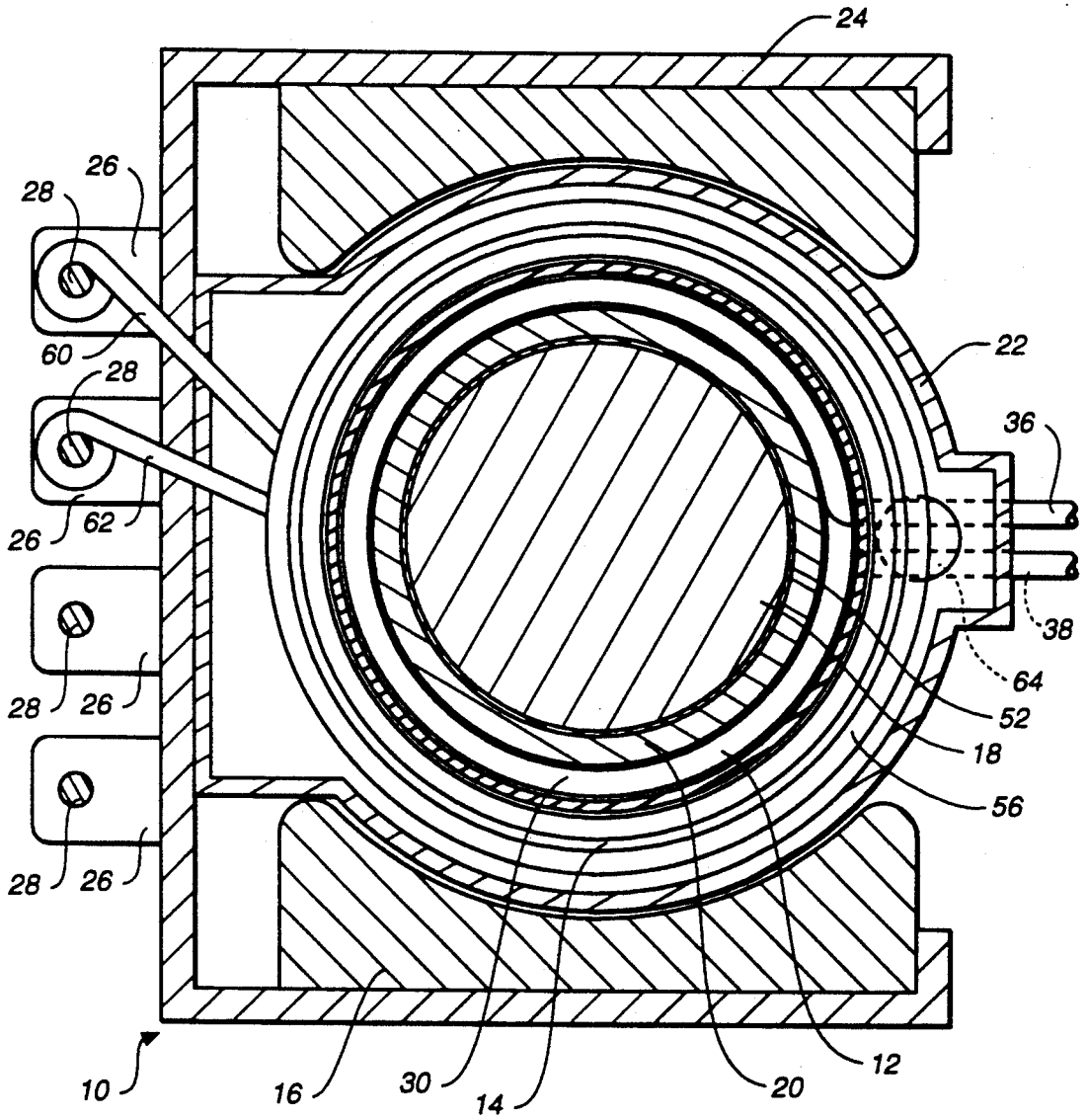
FIG. 2 is a section on the line 2—2 of FIG. 1.
Figure 3:
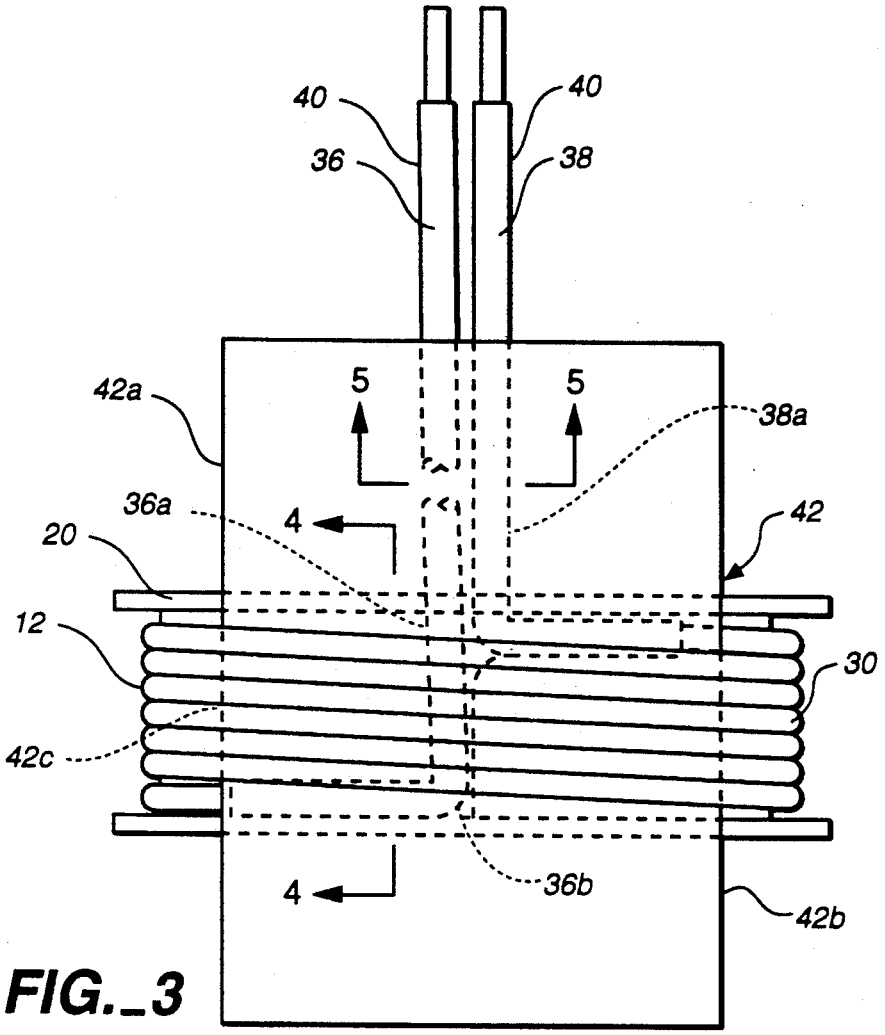
FIG. 3 is an elevational detail of a first winding during its manufacture.

The transformer 10 according to the invention comprises a first winding 12 and a second winding 14. These are positioned within a ferrite block 16 made of two identical halves 16*a* and 16*b* and including a central cylindrical core 18.

As is conventional in such transformers the first winding 12 is wound around a cylindrical bobbin 20 whilst both windings are positioned within a thin, outer, open-topped plastics housing 22. The halves 16*a* and 16*b* of the ferrite block 16 are supported in an outer plastics casing 24. This has four lugs 26 each carrying a pin 28 to act as terminals, including terminals, for the ends of the wires constituting the winding 14.

Figure 5:
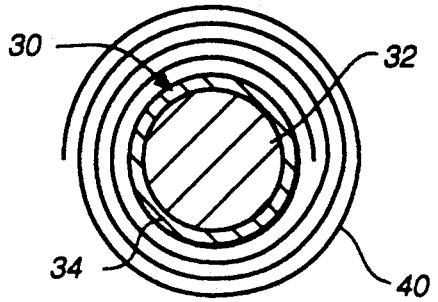
FIG. 5 is an enlarged detail taken on the line 5—5 of FIG. 3.

The first winding 12 is made by coiling a length of enamelled wire 30, i.e. a wire core 32 with its own enamelled coating 34 (see FIG. 5), around the bobbin 20. Before making the first turn, however, the ends 36 and 38 of the wire 30 are provided with an extra wrapping of insulation 40 (see FIG. 5). This insulation 40 is in the form of a thin, e.g. 0.05 mm thick, rectangular sheet of safety insulating material, such as Teflon or polyester, and is wrapped or coiled three and a half turns around the ends 36 and 38. This provides multi-layered insulation to meet the safety requirements of supplementary insulation, namely two layers of insulation and sufficient creepage distance.

A length 36*a* of the end 36 is initially laid transversely across the bobbin and then bent at a point 36*b* to start the circumferentially wound coil. Over the length 36*a* is placed a sheet of insulation 42 formed by two pieces of safety insulation material stuck together face to face, the two being required to meet the regulation of two separate layers so that if one fails the other will still be available to act as insulation. Each piece of safety insulation material can be of similar material and thickness to the insulation 40. This sheet 42 has a larger flap portion 42*a* and a smaller flap portion 42*b* with a central portion 42*c* extending across the width of the bobbin 20. The first winding is then formed by coiling the wire 30 around the bobbin 20 in a conventional manner, covering the central portion 42*c*.

In the example shown there is one layer to the winding 12 but this is purely an example and there may be more layers depending upon the particular requirements for the transformer 10.

As the winding nears completion, the end 38 is slipped under the flap 42*a* and the end portion 38*a* is bent out of the side of the bobbin, parallel with the length 36*a*.

Figure 4:
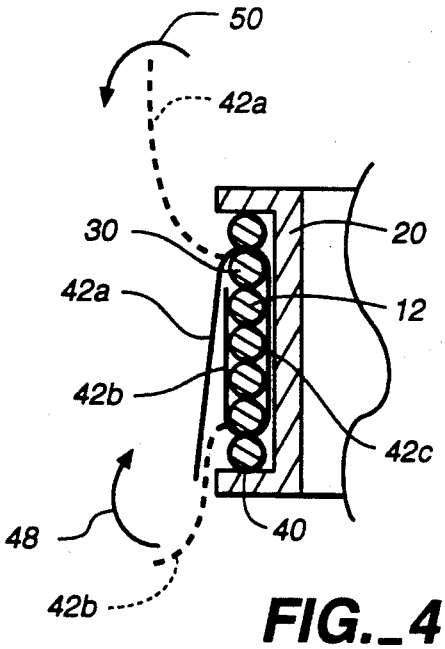
FIG. 4 is a sectional diagram taken on line 4—4 of FIG. 3 showing a further stage during manufacture.

Next the smaller flap 42*b* is folded over the turns of the winding 12 in the direction of the arrow 48 in FIG. 4 and after that the larger flap 42*a* is folded over that flap 42*b* in the direction of the arrow 50 in FIG. 4.

Figure 7:
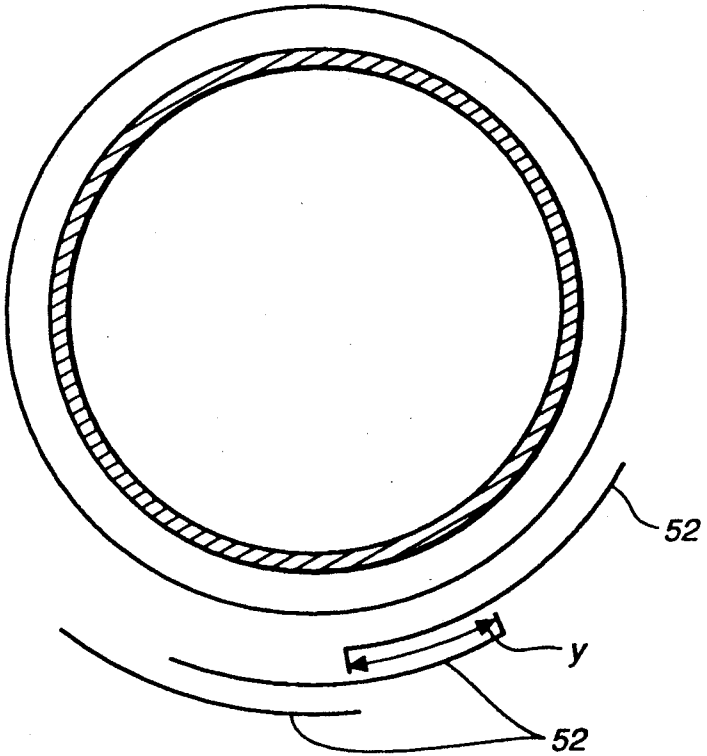
FIG. 7 is a sectional diagram taken on the line 7—7 of FIG. 6.
Figure 6:
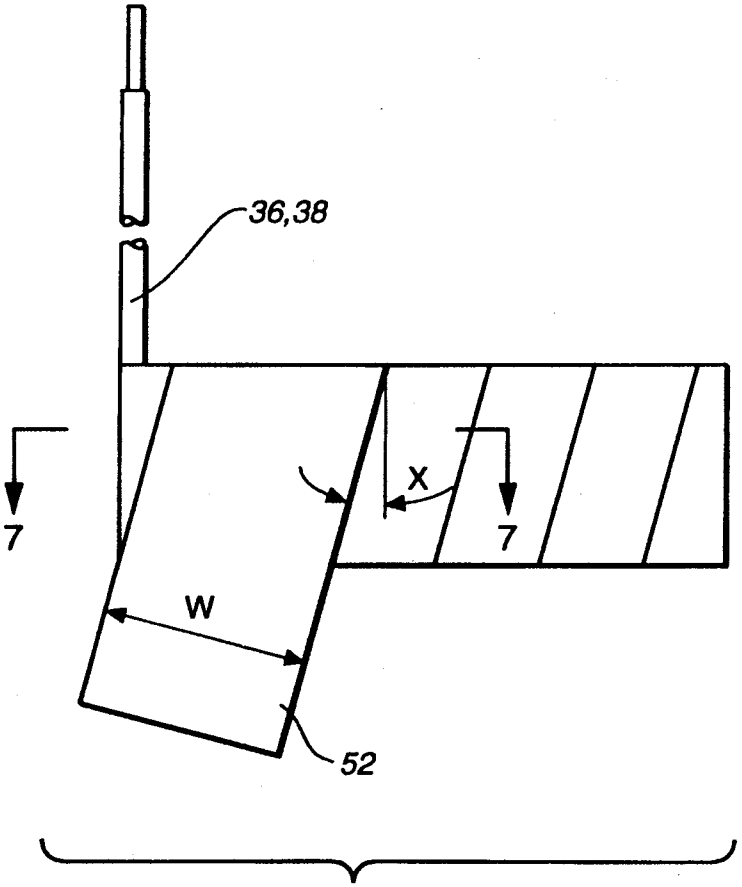
FIG. 6 is an elevational detail of the first winding during its manufacture.

Finally as best shown in FIGS. 6 and 7, to insulate the winding 12, a strip of insulation 52 is torroidally wound over the bobbin and coil of wire 30. The arrangement of the winding angle x and the width w of the strip 52 is such that everywhere there are at least two overlapping thicknesses of safety insulation and sufficient creepage.

The second winding 14 is now formed over this structure by coiling a length of safety insulated wire 56 over the wrapped winding 12. In the example shown, there are two layers of coils but again this will depend upon the actual structure of the transformer required.

The whole of the resulting structure is then placed within the housing 22, the ends 36 and 38 of the winding 12 passing through a hole 64 in the housing 22. Finally the two halves 16*a* and 16*b* of the ferrite block 16 are assembled around the housing 22 and the block positioned within the casing 24. Assembly is completed by joining the ends 60 and 62 to their respective pins 28 to provide terminal connections for the transformer.

In the example shown the wire 30 is enamelled whilst the wire 56 is covered with a high quality insulating coating of Teflon (Registered Trade Mark). Such wire is readily available from many sources including the American company known as Alpha. Because of its high quality it can be relatively thin yet still meet the safety requirements for basic insulation. Over the major portion of the winding 12, the layers of the strip 52 overlap and so the minimum safety requirements of supplementary insulation of two insulating layers between the first winding 12 and the second winding 14 are met.

The strip 52 need be no thicker than say 25 microns. As a result the overall radial thickness of the insulation could be say 75 microns, i.e. 0.075 mm, which is much less than plastics bobbins with insulation thicknesses of over 1 mm. As a result the winding 14 can be radially closer to the winding 12 and so flux leakage will be reduced.

The strip 52 can for example be a polyester tape, e.g., poly (ethylene terephthalate) or poly (butylene terephthalate), or other materials such as polyvinyl chloride or Teflon which is available in various grades as polytetrafluoroethylene, perfluorinated ethylene-propylene copolymer or polychlorotrifluoroethylene.

In addition the arrangement meets the creepage requirements since the overlapped surface dimension for the wrapping 52 is high, i.e. the length y with a wrapping 52 of a width w of 10 mm can be, for example, a minimum of 5 mm, which is well above normally required minimums.

The arrangement of the invention also maintains the necessary safety margins of insulation at the regions of the ends 36 and 38 where these leave the bobbin and where they cannot be covered by the layers of the strip 52. Thus, the flaps 42*a* and 42*b* ensure two layers of insulation and a safety creepage distance between the first winding and the second winding whilst the coiled wrapping of insulation 40 maintains the necessary safety insulation and a safety creepage distance for the ends 36 and 38.

In the embodiment shown in FIGS. 1 to 7, the requirement of at least three layers of safety approved insulation is achieved firstly by choosing as the coating for the wire 56 of the second winding a coating of Teflon which is an approved safety insulation, and secondly by providing overlapping of at least two layers of the strip 52 plus superimposing two thicknesses for the sheet 42 in the region of the ends 36 and 38.

Figure 9:
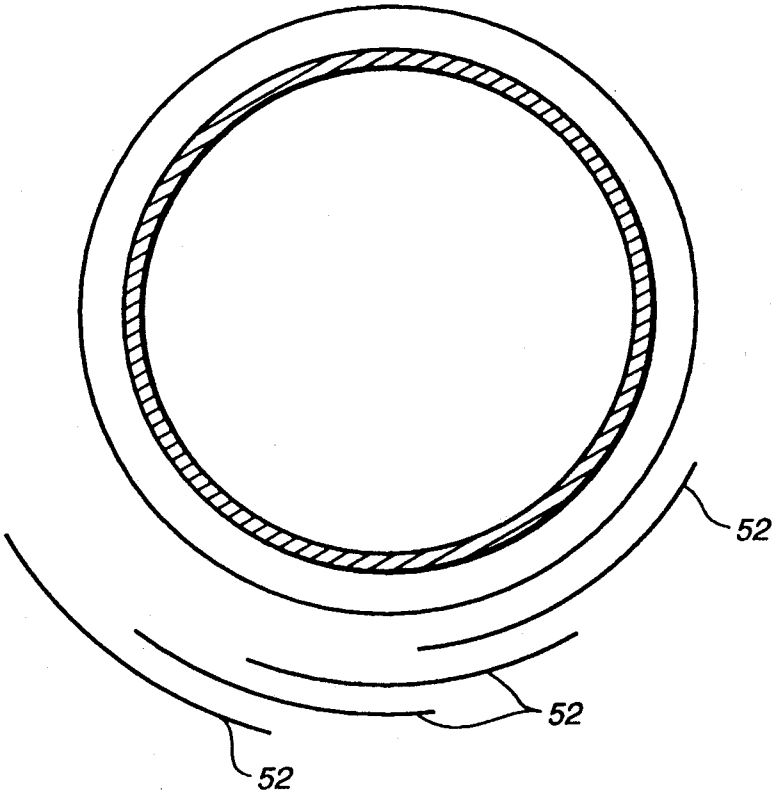
FIGS. 8 and 9 are views similar to FIGS. 6 and 7 of an alternative embodiment of a transformer.
Figure 8:
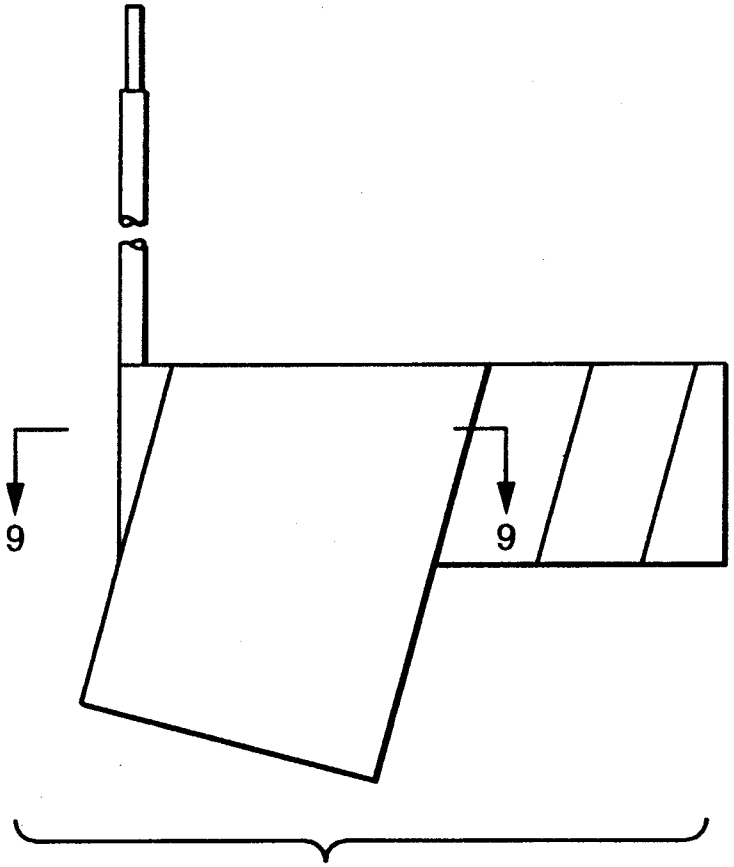

In an alternative embodiment shown in FIGS. 8 and 9, the wire 56 is a simple enamelled wire whose insulation properties do not meet the requirements of safety insulation. To compensate for this, the strip 52 is wrapped over the first winding in such a way that, as best seen in FIG. 9, there are at least three overlapping layers of the strip 52. This is achieved by, for example, using a wider strip 52 with a larger dimension w or by choosing a narrower angle x than in the case shown in FIG. 6. Additionally, to achieve the necessary three layers of safety insulation everywhere, the sheet of insulation 42 is formed by three superimposed pieces of material stuck together face to face.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A safety insulated transformer comprising:

a bobbin, a first winding formed by a coil of insulated wire wound on said bobbin, a magnetic core, a single thin strip of safety approved insulating material wrapped as a toroidal coil at an angle around the first winding, said angle being chosen such that there is an overlapping of successive layers of the wrapping to form at least two layers of insulation in each successive wrapping using said single thin strip of safety approved insulating material, an end insulation for the ends of the insulated wire of the first winding in the region where these ends leave the coil, the end insulation comprising:

coiled overlapped layers of safety insulating material wrapped around those ends, and a layer of additional safety insulation material of at least two superimposed thicknesses, said additional layer including a central portion, a first flap portion, and a second flap portion, said additional layer being placed substantially transversely across said bobbin such that said central portion covers a portion of said bobbin, a portion of said coil of insulated wire being wound over said central portion, said first flap portion being bent over the outer portion of said coil and said second flap portion being bent over said first flap portion, and a second winding formed by a coil of insulated wire wound over the wrapped first coil, there being at least two layers of safety approved insulating material between any parts of the wires forming the first and the second windings.

2. A transformer as claimed in claim 1 in which the said layer of additional safety insulation material makes a minimum of one and one half turns transversely of the coil.

3. A transformer of claim 1 in which the ends of the wire for the first winding leave that winding together at approximately the same circumferential position between the same overlapping layers of the wrapping.

4. A transformer as claimed in claim 1 in which the wire of the first and second winding are non-safety insulated wires, and in which there is overlapping of at least three successive layers of the wrapping forming the toroidal coil.

5. A transformer as claimed in claim 4 in which the said layer of additional safety insulation material makes a minimum of one and one half turns transversely of the coil.

6. A transformer as claimed in claim 5 in which the ends of the wire for the first winding leave that winding together at approximately the same circumferential position between the same overlapping layers of the wrapping.

7. A transformer as claimed in claim 1 in which the strip of safety approved insulating material is of a thickness of from 0.2 mm to 0.4 mm.

8. A transformer as claimed in claim 7 in which the said thickness is from 0.025 mm to 0.1 mm.

* * * * *